US007155748B2

(12) United States Patent
Vierkant, III et al.

(10) Patent No.: US 7,155,748 B2
(45) Date of Patent: Jan. 2, 2007

(54) RELEASABLE TOILET SEAT ASSEMBLY

(75) Inventors: Erich C. Vierkant, III, Sheboygan, WI (US); Daniel N. Halloran, Saukeville, WI (US)

(73) Assignee: Kohler Co., Kohler, WI (US)

( * ) Notice: Subject to any disclaimer, the term of this patent is extended or adjusted under 35 U.S.C. 154(b) by 236 days.

(21) Appl. No.: 10/816,359

(22) Filed: Apr. 1, 2004

(65) Prior Publication Data

US 2005/0217008 A1 Oct. 6, 2005

(51) Int. Cl.
*A47K 13/12* (2006.01)

(52) U.S. Cl. ..... 4/240; 4/236

(58) Field of Classification Search ..... 4/236, 4/240

See application file for complete search history.

(56) References Cited

U.S. PATENT DOCUMENTS

| | | | | |
|---|---|---|---|---|
| 4,080,671 | A | 3/1978 | Stähli | |
| 4,133,061 | A | 1/1979 | Hurd | |
| 4,159,548 | A | 7/1979 | Hewson | |
| 4,173,802 | A | 11/1979 | Wikstrom | |
| 4,309,780 | A | 1/1982 | Fantetti | |
| 4,319,365 | A | 3/1982 | Bemis et al. | |
| 4,326,307 | A | 4/1982 | Baillie et al. | |
| 4,832,573 | A | 5/1989 | Dorski | |
| 4,970,731 | A | 11/1990 | Fait | |
| 4,985,939 | A | 1/1991 | Otte | |
| 5,175,891 | A | 1/1993 | Ohshima et al. | |
| 5,341,517 | A * | 8/1994 | Bly | 4/236 |
| 5,515,552 | A | 5/1996 | Tolsma | |
| 5,666,672 | A | 9/1997 | Birsel et al. | |
| 5,901,383 | A | 5/1999 | Yanagawa et al. | |
| 5,933,875 | A | 8/1999 | Hulsebus et al. | |
| 6,070,295 | A | 6/2000 | Hulsebus | |
| 6,263,516 | B1 * | 7/2001 | Pedersen et al. | 4/236 |
| 6,381,762 | B1 | 5/2002 | Moser | |
| 6,643,851 | B1 * | 11/2003 | Janes | 4/236 |

FOREIGN PATENT DOCUMENTS

| | | |
|---|---|---|
| GB | 2280219 A | 1/1995 |
| JP | 9-84724 | 3/1997 |

* cited by examiner

*Primary Examiner*—Khoa D. Huynh
(74) *Attorney, Agent, or Firm*—Quarles & Brady LLP

(57) ABSTRACT

A mount assembly releasable mounts a toilet seat and cover to a toilet base. The assembly includes two fasteners permanently affixed to the toilet base engaged by deflectable arms of one or two base members of the mount assembly. The arms engage ring mounts disposed about the fasteners, flexing outward slightly during mounting and dismounting achieved by a simple horizontal sliding motion. When connected, hinged covers snap onto the pair of arms to cover the fasteners and prevent deflection of the arms and thus separation of the base member(s) from the fasteners.

11 Claims, 3 Drawing Sheets

FIG. 1
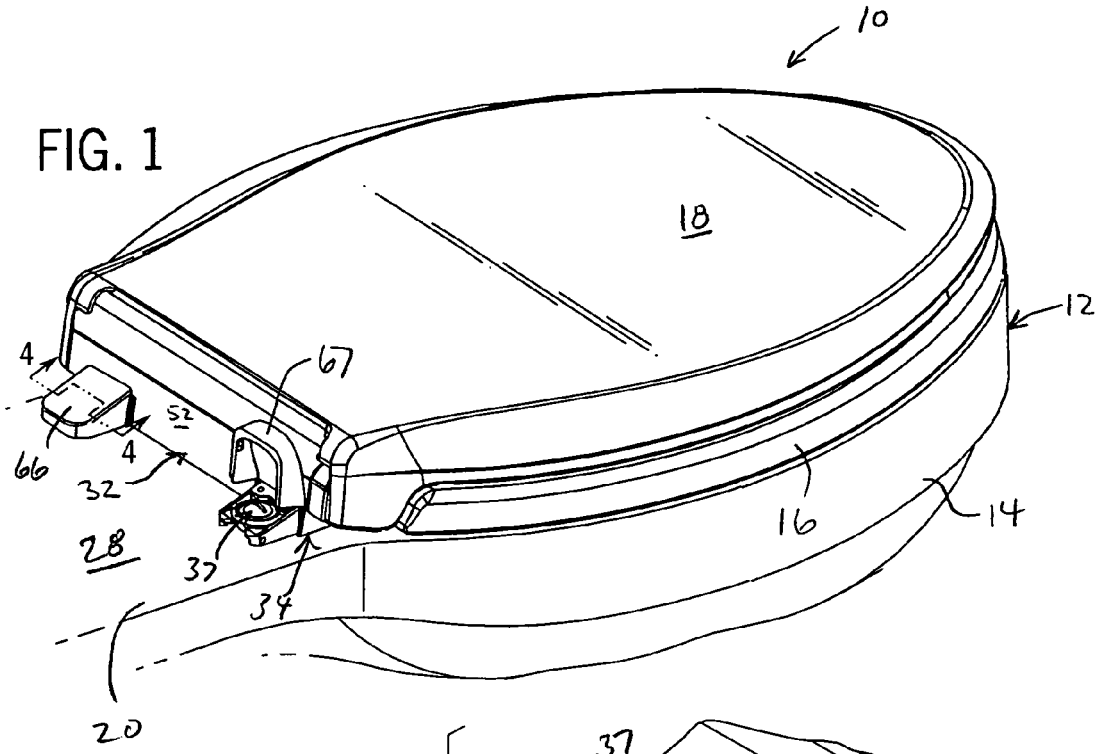
FIG. 2
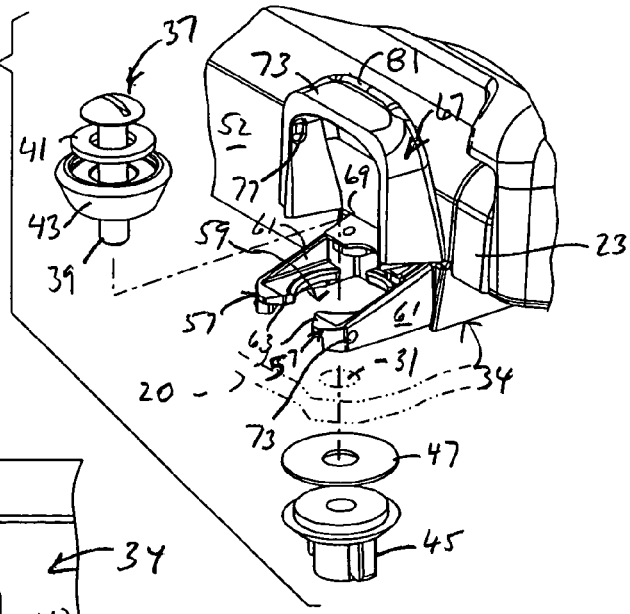
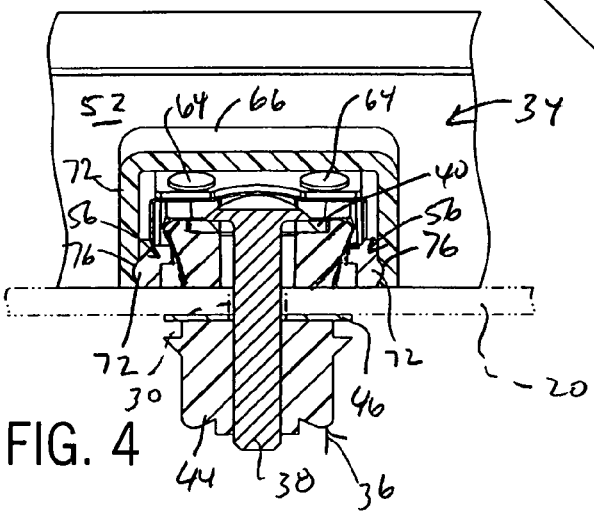
FIG. 4

FIG. 5
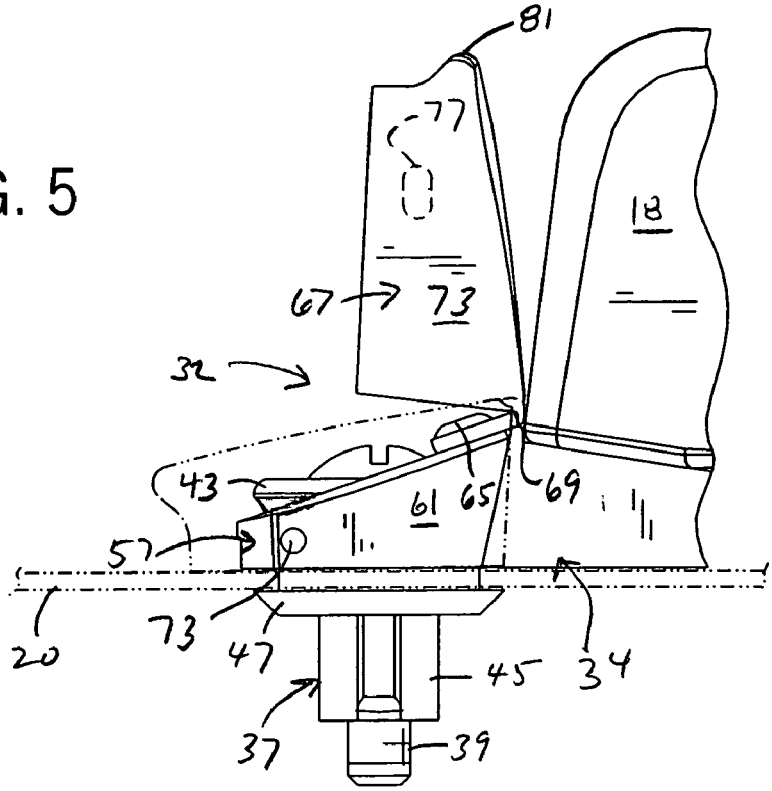
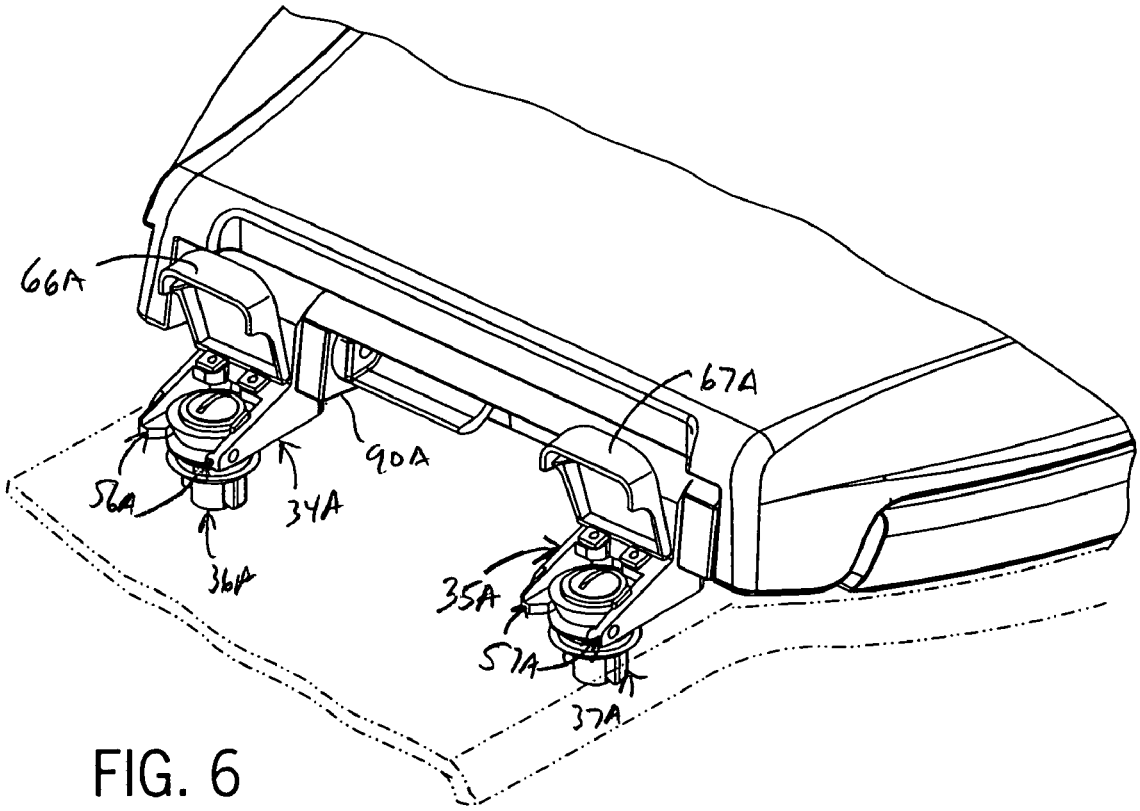
FIG. 6

RELEASABLE TOILET SEAT ASSEMBLY

CROSS-REFERENCE TO RELATED APPLICATION

Not applicable.

STATEMENT OF FEDERALLY SPONSORED RESEARCH/DEVELOPMENT

Not applicable.

BACKGROUND OF THE INVENTION

The present invention relates to mounting toilet seats and/or covers to the top of toilet bowls. More particularly, it relates to assemblies that permit most of the assembly parts to be readily removed from the toilet to facilitate cleaning.

Typically, toilet seats and covers are sold pre-assembled together along a hinge assembly. The assembly is then affixed via hinge posts to a rearward extension of the toilet base behind the bowl. In such constructions the posts are typically bolted to the rearward extension using a bolt-like fastener that extends down through the extension. A nut threads onto the fastener from underneath the extension to clamp the assembly to the extension.

These assemblies are intended to be essentially permanently affixed to the toilet base extension, particularly given that assembly and removal requires the application of tooling at the underside of the extension. This can create a problem because the area around such hinge posts (behind and under the cover and seat) can be difficult to clean thoroughly. In this regard, urine and other contaminants can collect around the hinge posts, with the subsequent development of an undesirable appearance or smell, or unsanitary conditions.

As such, there have been a number of attempts to develop toilet seat hinge assemblies where the seat and cover and associated pivot pins can be removed from the toilet relatively easily, and then (after cleaning) be relatively easily reconnected. See e.g. U.S. Pat. Nos. 4,159,548; 4,326,307; 4,965,889; 5,933,875; and 6,070,295, and British publication GB 2,280,219 A.

These systems achieve better cleaning by leaving only small base posts essentially permanently affixed to the toilet base, while providing readily releasable subassemblies that can removably link up with these posts. However, these prior art systems have a variety of deficiencies.

For example, some rely on a relatively weak connection between the subassembly and base posts such that the subassembly can accidentally be knocked off the posts. Others rely on relatively weak parts which may have a high incidence of breakage over prolonged use. Still others require relatively complex multi-part assemblies, which increase the cost of production and may require some consumer training. Still other assemblies require tools for the disassembly for cleaning purposes. Yet others require a consumer to touch portions of the assembly that may themselves be contaminated.

Hence, it can be seen that a need still exists for an improved toilet seat mounting assembly, particularly one which facilitates removal of the seat and cover for cleaning purposes.

BRIEF SUMMARY OF THE INVENTION

The present invention provides a mounting assembly for connecting a covering element (e.g., a toilet seat, a toilet cover, or a toilet seat/cover combination) to a toilet base. The preferred mounting location is a horizontal upwardly facing surface of a rearward extension of the toilet base behind the bowl.

One aspect of the invention provides such an assembly having a fastener extendable through the rear extension of the toilet base and a base member adapted to pivotally support the cover that has an essentially horizontal, deflectable extension arm and an opening for receiving the fastener. The base member is connected to and disconnected from the fastener by deflection of the extension arm so that the base member can be removably attached to the toilet base.

In one preferred form, the base member can have a pair of spaced apart, essentially horizontal extension arms, with one or both being deflectable. Each extension arm can have an inwardly facing catch surface. The catch surface(s) can engage a ring mount portion of the fastener. A threaded bolt can be secured to the toilet base by a nut underneath the base extension.

The assembly can also include a cover element connected to the base member. In a first upright position the cover permits the extension to deflect and in a second downward or horizontal position it restricts deflection of the extension arm(s) and thereby separation of the base member from the fastener. The base member can be releasably mounted to the toilet base by pivoting the cover into the down or closed position, release being achieved by moving the cover back to the upright position. In the closed position, the cover conceals the fastener from above.

Each cover can be pivotally connected to the base member, preferably by a living hinge. The cover can thereby move into abutment with the extension arm(s) to prevent deflection. The cover can positively engage the extension arm(s) such as in a snap fit between mating detent features.

The assembly preferably includes a pair of fasteners that fit through a pair of holes in the rear extension of standard toilet bowl bases. The base member would thus include two receivers allowing for deflectable engagement with the fasteners. The receivers could be joined together in spaced relation as part of a single base member, or they may be part of two individual base members.

Thus, the present invention provides a quick connect/disconnect assembly for releasably attaching a toilet seat and cover to a toilet base. This assembly has two fastener assemblies essentially permanently attached to the toilet bowl base rearward extension at two spaced apart mounting hole. The other assembly components, namely the base member(s) and the toilet seat/cover can be completely removed from the toilet base to facilitate thorough cleaning. The connection is a simple snap together connection. With the fasteners attached to the toilet base and the base member (s) attached to the toilet seat/cover, the base member(s) snap around the fasteners, for example by deflection of one or more of the extension arms, and each cover is then moved to lock the deflectable arms. This secures the connection and conceals the fasteners for a more pleasing appearance. The toilet seat/cover can be removed by lifting the cover(s) and sliding the toilet seat/cover laterally in the back-to-front direction.

It will be appreciated that the assembly of the present invention has a number of important advantages. For one thing, it is comprised of few parts and thus can be inexpensively manufactured. Further, its mechanism of operation does not require a consumer to touch an area of the assembly that is likely to be contaminated. Moreover, the connection is solid, thereby precluding accidental undesired dislodging of the assembly. Further, the parts can be formed to present an aesthetically pleasing appearance.

The present invention permits rapid assembly and disassembly of the seat and cover from the top of the toilet base, without special tools or training. These and still other advantages of the present invention will be apparent from the description that follows. The claims should be looked to in order to ascertain the full scope of the invention.

BRIEF DESCRIPTION OF THE DRAWINGS

FIG. 1 is a rear perspective view showing a toilet seat mount assembly of the present invention mounted on a toilet base rear extension, with one cover member of the mount assembly shown in an upward position;

FIG. 2 is a partial exploded perspective view of the assembly of FIG. 1 showing one part of the mount assembly enlarged;

FIG. 4 is a sectional view taken along line 4—4 of FIG. 1;

FIG. 5 is a partial side view of one part of the mount assembly showing one cover member pivoted up, the cover member being also shown in phantom in a downward closed position; and FIG. 6 is a rear respective view of an alternate embodiment of the toilet seat mount assembly having two separate base members.

DETAILED DESCRIPTION OF THE PREFERRED EMBODIMENTS

Figure 3:
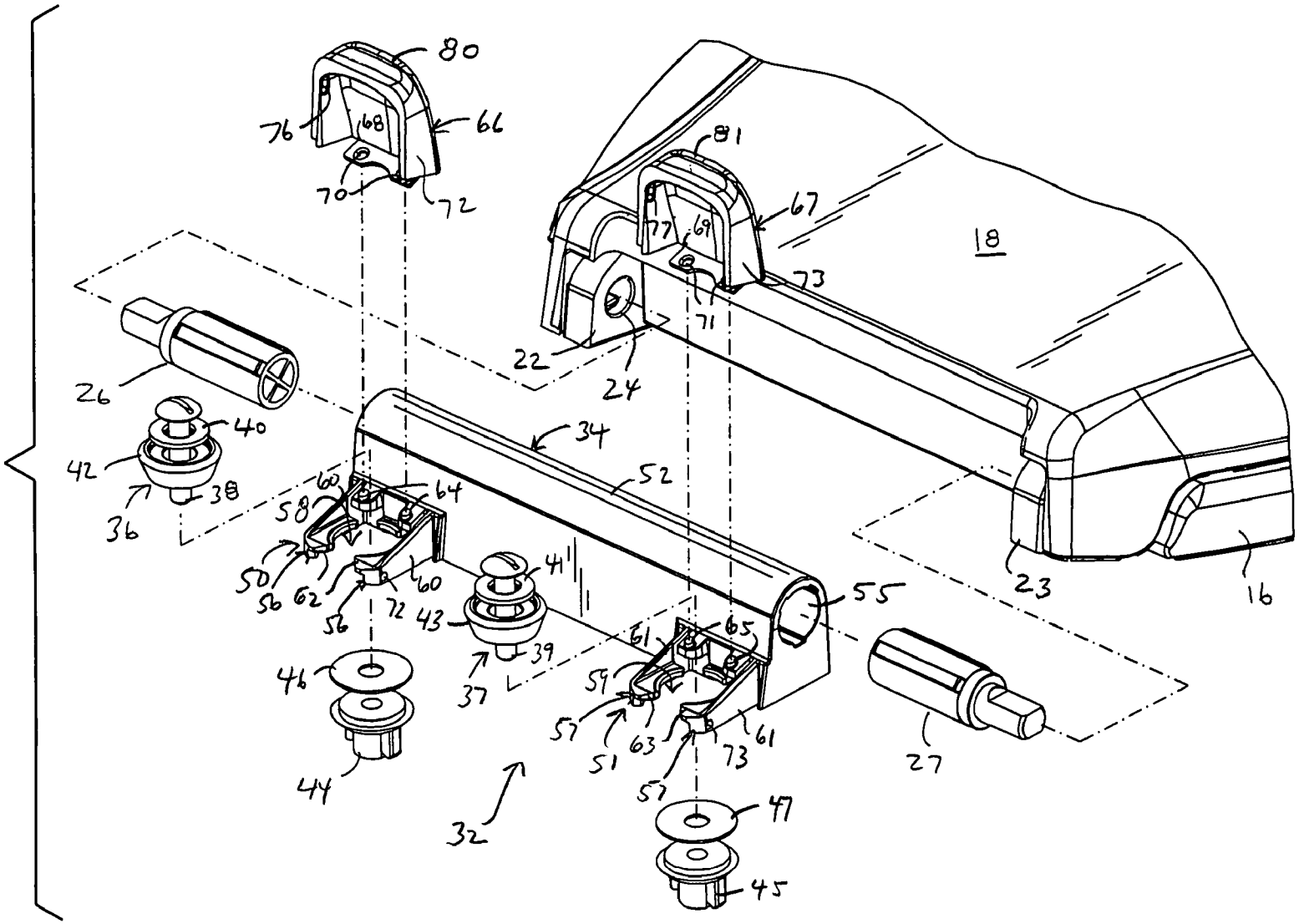
FIG. 3 is an exploded perspective view of the assembly of FIG. 1.

Referring now to FIG. 1, a toilet assembly 10 includes a conventional toilet base 12 having a bowl 14 with a seat 16 and cover 18 mounted to an extension 20 of the toilet base 12 at the rear of the bowl 14. As shown in FIG. 3, the seat 16 and cover 18 have ears 22 and 23 each with a horizontal opening 24 (one shown) for receiving the rotatable shafts of hinge pins 26 and 27, respectively, to pivotally mount the seat 16 and cover 18 for pivoting along a horizontal axis parallel to the top plane of the toilet base 12. The rearward extension 20 of the toilet base 12 has a flat top surface 28 with two vertical through holes 30 and 31. The through holes provide the location attaching the toilet seat 16 and cover 18 to the toilet base 12 using the mounting assembly of the present invention, generally referred by number 32 shown in FIG. 1.

Referring to FIGS. 2–5, the mounting assembly 32 includes a base member 34 and a pair of fastener assemblies 36 and 37. The fastener assemblies 36 and 37 include threaded bolts 38 and 39 about which are disposed washers 40 and 41 and ring mounts 42 and 43, respectively. The bolts 38 and 39 fit into the holes 30 and 31 in the rear extension 20 of the toilet base 12 from the top, with the washers 40 and 41 and the ring mounts 42 and 43 captured between the heads of the bolts 38 and 39 and the top surface 28 of the rear extension 20. These components are secured to the toilet base 12 snugly by tightening nuts 44 and 45 onto the respective bolts 38 and 39 from the underside of the rear extension 20. Additional washers 46 and 47 can be included at the underside of the rear extension 20.

The base member 34 has two receivers 50 and 51 which cooperate with the respective fastener assemblies 36 and 37 to releasable mount the seat 16 and cover 18 to the toilet base 12. The connection of the seat 16 and cover 18 to the base member is provided by an elongated support 52 with horizontal pockets 55 (one shown) which receive the stationary bodies of respective hinge pins 26 and 27. The receivers 50 and 51 are spaced apart near each end of the base support 52 to align with the fastener assemblies 36 and 37. Each receiver has a pair of arms 56 and 57 extending horizontally back from the base support 52. Within each pair, the arms 56 and 57 are spaced apart laterally to define vertical openings 58 and 59, which open to the back edge of the receivers. The arms 56 and 57 define vertical side walls 60 and 61, which taper downwardly form the base support 52, as well as inwardly extending catch surfaces 62 and 63. Two posts 64 and 65 project upwardly at or slightly above the top edge of the side walls 60 and 61 to mount covers 66 and 67. The covers 66 and 67 have flat panels that fold along living hinges 68 and 69 and have openings 70 and 71 for fitting around the respective posts 64 and 65. The living hinges 68 and 69 allow each of the covers 66 and 67 to pivot between an upright open position (as shown in FIG. 5) and a horizontal closed position (as shown in phantom in FIG. 5) to lock or unlock the base member 34 relative to the fastener assemblies 36 and 37, as will be described in detail below. The covers 66 and 67 have turned down peripheries 72 and 73 at their front and sides to overlap the arms 56 and 57. Small detents 74 and 75 at the outer side of the arms 56 and 57 can fit into corresponding recesses 76 and 77 (see FIG. 4) when the covers 66 and 67 are closed (down) to positively engage the arms 56 and 57 in a snap fit.

Referring generally to FIGS. 1–5, the assembly of the seat 16 and cover 18 to the toilet base 12 will now be described. It is envisioned that the mounting assembly 32 can be sold separately or as part of the seat 16 and cover 18. In either case, the base member 34 is attached to the to the seat 16 and cover 18 by assembling the hinge pins 26 and 27 into the pockets 55 of the base support 52 and the respective openings 24 in the ears 22 and 23 of the toilet seat 16 and cover 18. This sub-assembly then can be mounted to and dismounted from the toilet base 12 as a unit. During the initial assembly, the fastener assemblies 36 and 37 are mounted to the rear extension 20 of the toilet base 12 as mentioned above. A tightening tool, such as wrench, may be used during initial set up to tightly secure the fastener assemblies 36 and 37 to the toilet base 12. Once secured, the fastener assemblies 36 and 37 stay mounted to the toilet base 12. The base member 34 and the seat 16 and cover 18 are attached to the fastener assemblies 36 and 37 by sliding the base member 34 (and seat and cover) horizontally in the front-to-back direction with the covers 66 and 67 up. Catch surfaces 62 and 63 of the arms 56 and 57 are spaced apart less then the diameters of the ring mounts 42 and 43. As such, as the base member 34 (and seat and cover) are moved, the arms 56 and 57 will deflect outward to make space to accept the ring mounts 42 and 43 in the vertical openings 58 and 59. An outermost periphery at the top of the ring mounts 42 and 43 (which are held down by the heads of the bolts 38 and 39) will capture the arms 56 and 57 between the top surface 28 of the rear extension 20 to resist vertical movement of the base member 34. Also, the fit of the arms 56 and 57 around the ring mounts 42 and 43 is snug so that there is little or no slop from front to back or side to side. To prevent inadvertent separation of the base member 34 (and seat and cover) from the fastener assemblies 36 and 37 (and thus the toilet base 12), the covers 66 and 67 are pivoted down to the closed position to snap onto the arms 56 and 57 and thereby resist outward deflection of the arms 56 and 57. With the covers 56 and 57 down, the fastener assemblies 36 and 37 are concealed from above the toilet. This keeps debris from gathering around the fastener assemblies 36 and 37 and improves the appearance of the overall assembly. The described connection is made easily without tools, yet is robust and unlikely to be inadvertently disconnected.

When desired, such as when cleaning, the seat 16 and cover 18 (and base member 34) can be readily removed from the toilet base 12. The covers 66 and 67 are lifted up (raised edges 80 and 81 make the covers 66 and 67 easy to grasp) and the seat 16 and cover 18 (and base member 34) are pulled or slid straight (horizontally) away from the fastener assemblies 36 and 37. With the covers 66 and 67 up, the arms 56 and 57 are free to deflect outward and thereby disengage the catch surfaces 62 and 63 from the ring mounts 42 and 43. As mentioned, with the seat 16 and cover 18 also goes the base member 34, and thus, the only components left attached to the toilet base 12 are the fastener assemblies 36 and 37. These assemblies 36 and 37 have a small footprint, which leaves nearly all of the top surface 28 of the rear extension 20 of the toilet base 12 exposed, thereby facilitating thorough cleaning.

Referring now to FIG. 6, in an alternative embodiment, rather than a single unitary base member with two receivers, there can be two separate, smaller base members 34A and 35A each having its own pair of extension arms 56A and 57A, cover 66A and 67A, and pocket (not shown) for the hinge pins. A center piece 90A would then fit between the two base members 34A and 35A. Like before, the arms 56A and 57A removably mate with fastener assemblies 36A and 37A permanently secured to the toilet base.

While preferred embodiments have been shown, a wide variety of changes can be made to them without departing from the spirit or scope of the invention. For example, while two deflectable extension arms are described for engaging each fastener, a single arm could be used and/or only a single arm may be deflectable while the other is rigid. Further, although a toilet covering member including both a cover and a seat has been described, it will be apparent that various types or combinations of covering members can be used. For example, it is not necessary there be both a cover and seat. Either can be attached alone if desired (e.g., for a public restroom just a seat is more typical).

Accordingly, the claims should be looked at in order to judge the full scope of the invention.

INDUSTRIAL APPLICABILITY

The present invention provides a mounting assembly suitable to attach a toilet seat and/or cover to a toilet base.

What is claimed is:

1. An assembly for mounting an attachment to a toilet base, the assembly comprising:

a fastener extendable through a rear extension of the toilet base;

a base member adapted to support the cover in pivotal fashion, the base member having a pair of essentially horizontally extending deflectable extension arms defining in part an opening for receiving the fastener, wherein the base member is connected to and disconnected from the fastener by deflection of the extension arms so that the base member is removably attachable to the toilet base; and a cover hingedly connected to the base member and pivotable between an open position in which outward deflection of the extension arms is permitted allow the base member to be connected to the fastener and a closed position in which outward deflection of the extension arms is restricted to prevent separation of the base member from the fastener.

2. The assembly of claim 1, wherein each extension arm has an inwardly facing catch surface.

3. The assembly of claim 1, wherein the cover is hinged to the base member.

4. The assembly of claim 3, wherein the cover is linked to the base member via a living hinge.

5. The assembly of claim 1, wherein the cover positively engages the extension arms.

6. The assembly of claim 1, further comprising a ring mount disposed about the fastener engageable with the extension arms.

7. The assembly of claim 1, wherein the fastener comprises a bolt extendable through the opening in the base member and a hole in the rear extension of the toilet base, and wherein the assembly further comprises a nut positionable on the bolt underneath the rear extension of the toilet base.

8. The assembly of claim 1, wherein there are two such fasteners and two such base members.

9. The assembly of claim 8, wherein the two base members are joined together.

10. The assembly of claim 1, wherein the attachment is selected from the group consisting of toilet seats, toilet covers, and combined toilet seats and covers.

11. The assembly of claim 1, wherein the base member can engage the fastener via an essentially horizontal relative sliding motion.

* * * * *